US010543399B2

(12) United States Patent
Inoue et al.

(10) Patent No.: US 10,543,399 B2
(45) Date of Patent: Jan. 28, 2020

(54) GOLF BALL

(71) Applicant: SUMITOMO RUBBER INDUSTRIES, LTD., Kobe-shi, Hyogo (JP)

(72) Inventors: Hidetaka Inoue, Kobe (JP); Kazuya Kamino, Kobe (JP)

(73) Assignee: SUMITOMO RUBBER INDUSTRIES, LTD., Kobe-Shi, Hyogo (JP)

( * ) Notice: Subject to any disclaimer, the term of this patent is extended or adjusted under 35 U.S.C. 154(b) by 0 days.

(21) Appl. No.: 16/014,950

(22) Filed: Jun. 21, 2018

(65) Prior Publication Data

US 2019/0015708 A1 Jan. 17, 2019

(30) Foreign Application Priority Data

Jul. 14, 2017 (JP) ..... 2017-137760

(51) Int. Cl.
*A63B 37/06* (2006.01)
*A63B 37/00* (2006.01)

(52) U.S. Cl.
CPC ..... *A63B 37/0031* (2013.01); *A63B 37/0045* (2013.01)

(58) Field of Classification Search
CPC ..... A63B 37/0076; A63B 37/0092
USPC ..... 473/376
See application file for complete search history.

(56) References Cited

U.S. PATENT DOCUMENTS

2013/0005505 A1 1/2013 Sajima et al.
2017/0095702 A1* 4/2017 Sullivan ..... A63B 37/0076

FOREIGN PATENT DOCUMENTS

JP 2013-9916 A 1/2013
JP 2013-248262 A 12/2013

* cited by examiner

*Primary Examiner* — Raeann Gorden
(74) *Attorney, Agent, or Firm* — Birch, Stewart, Kolasch & Birch, LLP

(57) ABSTRACT

A golf ball 2 includes a core 4, an inner cover 6, a main cover 8, and an outer cover 10. S=Hs×Rc×0.05, M=Hm×Tm, I=Hi×Ti, O=Ho×To, and Q=(I+O)/2 that are calculated from a radius Rc of the core 4, a Shore C hardness Hs at a surface of the core 4, a thickness Tm of the main cover 8, a Shore C hardness Hm of the main cover 8, a thickness Ti of the inner cover 6, a Shore C hardness Hi of the inner cover 6, a thickness To of the outer cover 10 and a Shore C hardness Ho of the outer cover 10, satisfy 15≤M−S≤100, 0.25<Q/M≤0.5, and 30<I−O.

11 Claims, 1 Drawing Sheet

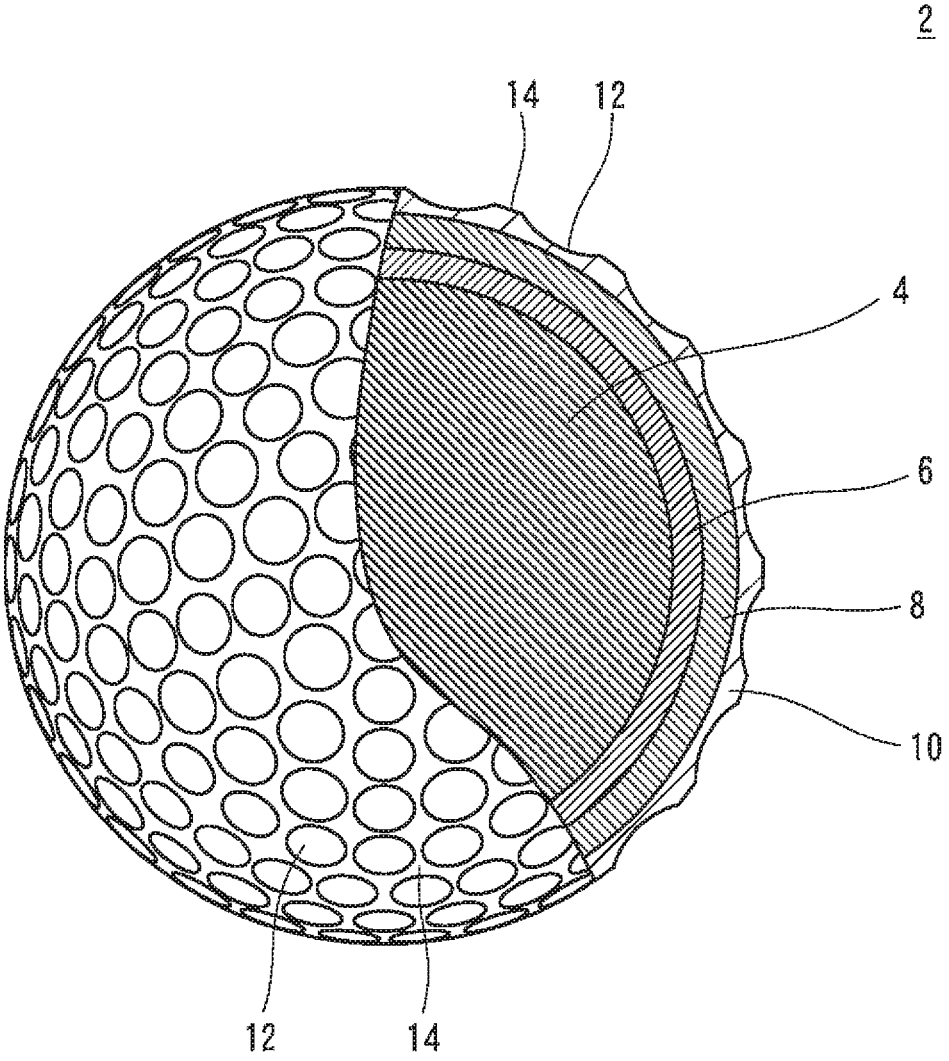
2
14
12
4
6
8
10
12
14

GOLF BALL

This application claims priority on Patent Application No. 2017-137760 filed in JAPAN on Jul. 14, 2017. The entire contents of this Japanese Patent Application are hereby incorporated by reference.

BACKGROUND OF THE INVENTION

Field of the Invention

The present invention relates to golf balls. Specifically, the present invention relates to golf balls including a core and a cover.

Description of the Related Art

In golf, golf balls are hit with a wood type club, an iron type club, a hybrid type club (utility), and a putter, etc. Feel at impact upon hitting is of interest to golf players. Generally, golf players prefer golf balls having soft feel at impact.

Meanwhile, golf players also place importance on flight performance upon shots with drivers. The flight performance correlates with the resilience performance of a golf ball. When a golf ball having excellent resilience performance is hit, the golf ball flies at a high speed, thereby achieving a large flight distance, but the feel provided to the golf player at impact is generally hard. In light of achieving both desired flight performance and desired feel at impact upon a shot with a driver, a golf ball having a multilayer cover has been proposed.

For example, JP2013-248262 and JP2013-9916 disclose golf balls each including a core and a cover having two or more layers. These golf balls have a feature in which the innermost layer of the cover has a JIS-C hardness equal to or less than the JIS-C hardness at the surface of the core.

There is still room for improvement for achievement of both desired flight performance and desired feel at impact upon a shot with a driver. In play by beginners, the frequency of a mishit upon putting is also high. With a golf ball having soft feel at impact, the response felt in the hands upon putting is excessively small, so that it may be difficult to grasp a sense of distance to the cup. In particular, in putting in which the distance between a golf ball and a cup is long, a beginner tends to hit the ball with stronger force than necessary, due to fear of insufficient hitting, so that excessive hitting often occurs. Golf balls that have proper feel at impact upon putting and with which a sense of distance is easily adjusted are desired.

An object of the present invention is to provide a golf ball that has excellent flight performance and feel at impact and that allows a sense of distance to be easily adjusted upon putting at a long distance.

SUMMARY OF THE INVENTION

As a result of thorough research, the present inventors have found that various performance characteristics which have been conventionally difficult to achieve can be improved in a balanced manner by using, as indexes, TH values calculated from the hardnesses and the thicknesses of respective layers of a multi-piece golf ball, and have completed the present invention. Here, regarding a layer that substantially does not have a hardness distribution, the TH value means the product of the hardness and the thickness of the layer. Regarding a layer that has a hardness distribution, a value obtained by multiplying the hardness at each point in the layer by 5% of the thickness of the layer is defined as the TH value.

A golf ball according to the present invention includes a core, an inner cover positioned outside the core, a main cover positioned outside the inner cover, and an outer cover positioned outside the main cover. In the golf ball, a TH value S at a surface of the core, a TH value M of the main cover, a TH value I of the inner cover, a TH value O of the outer cover, and an average Q are defined by the following formulas (1) to (5) from a radius Rc (mm) of the core, a Shore C hardness Hs at the surface of the core, a thickness Tm (mm) of the main cover, a Shore C hardness Hm of the main cover, a thickness Ti (mm) of the inner cover, a Shore C hardness Hi of the inner cover, a thickness To (mm) of the outer cover, and a Shore C hardness Ho of the outer cover.

$$S=Hs\times Rc\times 0.05 \quad (1)$$

$$M=Hm\times Tm \quad (2)$$

$$I=Hi\times Ti \quad (3)$$

$$O=Ho\times To \quad (4)$$

$$Q=(I+O)/2 \quad (5)$$

In the golf ball, the TH value S, the TH value M, the TH value I, the TH value O, and the average Q satisfy the following formulas (6) to (8).

$$15\leq M-S\leq 100 \quad (6)$$

$$0.25<Q/M\leq 0.5 \quad (7)$$

$$30<I-O \quad (8)$$

In the golf ball according to the present invention, the TH value of the main cover is appropriately adjusted with respect to the TH values of the respective layers. With the golf ball, both desired flight performance and desired feel at impact upon a shot with a driver are achieved. Furthermore, in the golf ball, the TH value of the inner cover and the TH value of the outer cover are also adjusted. When the golf ball is hit with a putter, appropriate response can be provided to the hands of the golf player. With the golf ball, even a beginner can easily adjust a sense of distance to a cup. Therefore, even when the distance to a cup is long, excessive hitting can be avoided.

Preferably, the TH value I and the TH value O satisfy the following formula (9).

$$30<I-O\leq 70 \quad (9)$$

Preferably, the TH value I, the TH value M, and the TH value O satisfy the following formula (10).

$$O<I<M \quad (10)$$

Preferably, the outer cover is the most flexible among the inner cover, the main cover, and the outer cover. Preferably, the outer cover is the thinnest among the inner cover, the main cover, and the outer cover.

Preferably, the hardness Ho is not less than 35 and not greater than 60. Preferably, the thickness To is not less than 0.2 mm and not greater than 0.8 mm.

BRIEF DESCRIPTION OF THE DRAWINGS

FIG. 1 is a partially cutaway cross-sectional view of a golf ball according to one embodiment of the present invention.

DESCRIPTION OF THE PREFERRED EMBODIMENTS

The following will describe in detail the present invention based on preferred embodiments with appropriate reference to the drawings.

A golf ball 2 shown in FIG. 1 includes a spherical core 4, an inner cover 6 positioned outside the core 4, a main cover 8 positioned outside the inner cover 6, and an outer cover 10 positioned outside the main cover 8. A large number of dimples 12 are formed on the surface of the outer cover 10. Of the surface of the golf ball 2, a part other than the dimples 12 is a land 14. The golf ball 2 includes a paint layer and a mark layer on the external side of the outer cover 10 although these layers are not shown in the drawing. The core 4 may be formed of two or more layers. The golf ball 2 may further include another layer between the main cover 8 and the inner cover 6. The golf ball 2 may further include another layer between the main cover 8 and the outer cover 10.

The golf ball 2 preferably has a diameter of not less than 40 mm but not greater than 45 mm. From the viewpoint of conformity to the rules established by the United States Golf Association (USGA), the diameter is particularly preferably not less than 42.67 mm. In light of suppression of air resistance, the diameter is more preferably not greater than 44 mm and particularly preferably not greater than 42.80 mm. The golf ball 2 preferably has a weight of not less than 40 g but not greater than 50 g. In light of attainment of great inertia, the weight is more preferably not less than 44 g and particularly preferably not less than 45.00 g. From the viewpoint of conformity to the rules established by the USGA, the weight is particularly preferably not greater than 45.93 g.

For the golf ball 2, a Shore C hardness Hc at the central point of the core 4 and a Shore C hardness Hs at the surface of the core 4 are measured. For the hardness measurements, a Shore C type hardness scale mounted to an automated hardness meter (trade name "digi test II" manufactured by Heinrich Bareiss Prüfgerätebau GmbH) is used. The hardness Hc is measured by the hardness scale being pressed against the cut plane of a hemisphere obtained by cutting the core 4. The hardness Hs is measured by the hardness scale being pressed against the surface of the core 4. All the measurements are conducted in an environment of 23° C.

For the golf ball 2, slab hardnesses of the inner cover 6, the main cover 8, and the outer cover 10 are measured. The slab hardnesses are measured according to the standards of "ASTM-D 2240-68". For the measurement, a sheet that is formed by hot press, that is formed from the same material as that of the inner cover 6, the main cover 8, or the outer cover 10, and that has a thickness of about 2 mm, is used. Prior to the measurement, a sheet is kept at 23° C. for two weeks. During the measurement, three sheets are stacked. A Shore C hardness Hi of the inner cover 6, a Shore C hardness Hm of the main cover 8, and a Shore C hardness Ho of the outer cover 10 are obtained with an automated hardness meter (the aforementioned "digi test II") to which a Shore C type hardness scale is mounted.

For the golf ball 2, a TH value S at the surface of the core 4, a TH value M of the main cover 8, a TH value I of the inner cover 6, a TH value O of the outer cover 10, and an average Q are calculated by the following formulas (1) to (5), respectively, from a radius Rc (mm) of the core 4, a thickness Ti (mm) of the inner cover 6, a thickness Tm (mm) of the main cover 8, a thickness To (mm) of the outer cover 10, the hardness Hs, the hardness Hi, the hardness Hm, and the hardness Ho. The radius Rc, the thickness Ti, the thickness Tm, and the thickness To are measured on the cut plane of a hemisphere obtained by cutting the golf ball 2.

$$S=Hs\times Rc\times 0.05 \quad (1)$$

$$M=Hm\times Tm \quad (2)$$

$$I=Hi\times Ti \quad (3)$$

$$O=Ho\times To \quad (4)$$

$$Q=(I+O)/2 \quad (5)$$

The difference (M−S) between the TH value M of the main cover 8 and the TH value S at the surface of the core 4 satisfies the following formula (6).

$$15\leq M-S\leq 100 \quad (6)$$

When the golf ball 2 having a difference (M−S) of not less than 15 is hit with a driver, the spin rate is reduced, and a high launch speed is achieved. The low spin rate and the high launch speed achieve a large flight distance. In light of flight performance, the difference (M−S) is preferably not less than 18 and more preferably not less than 20.

The golf ball 2 having a difference (M−S) of not greater than 100 has soft feel at impact upon a shot with a driver. From this viewpoint, the difference (M−S) is preferably not greater than 97 and more preferably not greater than 95.

The ratio Q/M of the average Q of the TH value I of the inner cover 6 and the TH value O of the outer cover 10 relative to the TH value M of the main cover 8 satisfies the following formula (7).

$$0.25<Q/M\leq 0.5 \quad (7)$$

With the golf ball 2 having a ratio Q/M that satisfies the above formula (7), both desired flight performance and desired feel at impact are achieved upon a shot with a driver. In light of feel at impact, the ratio Q/M is preferably not less than 0.30 and more preferably not less than 0.34. In light of flight performance, the ratio Q/M is preferably not greater than 0.48 and more preferably not greater than 0.46.

The difference (I−O) between the TH value I of the inner cover 6 and the TH value O of the outer cover 10 satisfies the following formula (8).

$$30<I-O \quad (8)$$

The golf ball 2 having a difference (I−O) exceeding 30 has proper feel at impact upon putting. A golf player who hits the golf ball 2 with a putter acquires an appropriately hard feel at impact. With the golf ball 2, even a beginner easily grasps a sense of distance upon putting, and thus excessive hitting can be avoided even when the distance to a cup is long. From this viewpoint, the difference (I−O) is preferably not less than 33 and more preferably not less than 35.

The TH value S at the surface of the core 4, the TH value M of the main cover 8, the TH value I of the inner cover 6, the TH value O of the outer cover 10, and the average Q are not particularly limited, and are selected as appropriate within the ranges where the above formulas (6) to (8) are satisfied.

The difference (I−O) between the TH value I of the inner cover 6 and the TH value O of the outer cover 10 preferably satisfies the following formula (9).

$$30<I-O\leq 70 \quad (9)$$

The golf ball 2 having a difference (I−O) of not greater than 70 has soft feel at impact upon a shot with a driver.

From this viewpoint, the difference (I–O) is more preferably not greater than 65 and particularly preferably not greater than 60.

The TH value I of the inner cover 6, the TH value M of the main cover 8, and the TH value O of the outer cover 10 further preferably satisfy the following formula (10).

$$O<I<M \quad (10)$$

In the golf ball 2 in which the TH value I, the TH value M, and the TH value O satisfy the above formula (10), the main cover that is relatively hard and thick and the inner cover and the outer cover that are relatively thin and flexible contribute to achievement of both desired flight performance and desired feel at impact upon a shot with a driver. Furthermore, with the golf ball 2, an effect that the outer cover that is particularly thin and flexible provides suitable feel at impact upon putting is obtained.

In light of flight performance, the difference (M–I) between the TH value M and the TH value I is preferably not less than 10 and more preferably not less than 15. In light of feel at impact, the difference (M–I) is preferably not greater than 70 and more preferably not greater than 60.

In light of feel at impact, the difference (M–O) between the TH value M and the TH value O is preferably not less than 55 and more preferably not less than 60. In light of flight performance, the difference (M–O) is preferably not greater than 90 and more preferably not greater than 80.

The following will sequentially describe preferable configurations and materials of the core 4, the inner cover 6, the main cover 8, and the outer cover 10 in this embodiment. The golf ball 2 may further include a layer formed from another material as long as the object of the present invention is achieved.

The core 4 included in the golf ball 2 is formed by crosslinking a rubber composition. Examples of preferable base rubbers for use in the rubber composition include polybutadienes, polyisoprenes, styrene-butadiene copolymers, ethylene-propylene-diene copolymers, and natural rubbers. In light of resilience performance, polybutadienes are preferable. When a polybutadiene and another rubber are used in combination, it is preferred if the polybutadiene is a principal component. Specifically, the proportion of the polybutadiene to the entire base rubber is preferably not less than 50% by weight and particularly preferably not less than 80% by weight. A polybutadiene in which the proportion of cis-1,4 bonds is not less than 80% is particularly preferable.

The rubber composition of the core 4 preferably includes a co-crosslinking agent. Preferable co-crosslinking agents in light of resilience performance are monovalent or bivalent metal salts of an α,β-unsaturated carboxylic acid having 2 to 8 carbon atoms. Examples of preferable co-crosslinking agents include zinc acrylate, magnesium acrylate, zinc methacrylate, and magnesium methacrylate. In light of resilience performance of the golf ball 2, zinc acrylate and zinc methacrylate are particularly preferable.

The rubber composition may include a metal oxide and an α,β-unsaturated carboxylic acid having 2 to 8 carbon atoms. They both react with each other in the rubber composition to obtain a salt. The salt serves as a co-crosslinking agent. Examples of preferable α,β-unsaturated carboxylic acids include acrylic acid and methacrylic acid. Examples of preferable metal oxides include zinc oxide and magnesium oxide.

The amount of the co-crosslinking agent per 100 parts by weight of the base rubber is preferably not less than 10 parts by weight. The golf ball 2 that includes the core 4 in which this amount is not less than 10 parts by weight has excellent resilience performance. From this viewpoint, the amount of the co-crosslinking agent is more preferably not less than 15 parts by weight and particularly preferably not less than 20 parts by weight. In light of feel at impact, the amount of the co-crosslinking agent is preferably not greater than 45 parts by weight, more preferably not greater than 40 parts by weight, and particularly preferably not greater than 35 parts by weight.

Preferably, the rubber composition of the core 4 includes an organic peroxide. The organic peroxide serves as a crosslinking initiator. The organic peroxide contributes to the resilience performance of the golf ball 2. Examples of suitable organic peroxides include dicumyl peroxide, 1,1-bis(t-butylperoxy)-3,3,5-trimethylcyclohexane, 2,5-dimethyl-2,5-di(t-butylperoxy)hexane, and di-t-butyl peroxide. An organic peroxide with particularly high versatility is dicumyl peroxide.

The amount of the organic peroxide per 100 parts by weight of the base rubber is preferably not less than 0.1 parts by weight. The golf ball 2 that includes the core 4 in which this amount is not less than 0.1 parts by weight has excellent resilience performance. From this viewpoint, the amount of the organic peroxide is more preferably not less than 0.3 parts by weight and particularly preferably not less than 0.5 parts by weight. In light of feel at impact, the amount of the organic peroxide is preferably not greater than 3.0 parts by weight, more preferably not greater than 2.5 parts by weight, and particularly preferably not greater than 2.0 parts by weight.

The rubber composition of the core 4 includes an organic sulfur compound. Organic sulfur compounds include naphthalenethiol compounds, benzenethiol compounds, and disulfide compounds. Disulfide compounds are preferable.

Examples of naphthalenethiol compounds include 1-naphthalenethiol, 2-naphthalenethiol, 4-chloro-1-naphthalenethiol, 4-bromo-1-naphthalenethiol, 1-chloro-2-naphthalenethiol, 1-bromo-2-naphthalenethiol, 1-fluoro-2-naphthalenethiol, 1-cyano-2-naphthalenethiol, and 1-acetyl-2-naphthalenethiol.

Examples of benzenethiol compounds include benzenethiol, 4-chlorobenzenethiol, 3-chlorobenzenethiol, 4-bromobenzenethiol, 3-bromobenzenethiol, 4-fluorobenzenethiol, 4-iodobenzenethiol, 2,5-dichlorobenzenethiol, 3,5-dichlorobenzenethiol, 2,6-dichlorobenzenethiol, 2,5-dibromobenzenethiol, 3,5-dibromobenzenethiol, 2-chloro-5-bromobenzenethiol, 2,4,6-trichlorobenzenethiol, 2,3,4,5,6-pentachlorobenzenethiol, 2,3,4,5,6-pentafluorobenzenethiol, 4-cyanobenzenethiol, 2-cyanobenzenethiol, 4-nitrobenzenethiol, and 2-nitrobenzenethiol.

Examples of disulfide compounds include diphenyl disulfide, bis(4-chlorophenyl)disulfide, bis(3-chlorophenyl)disulfide, bis(4-bromophenyl)disulfide, bis(3-bromophenyl)disulfide, bis(4-fluorophenyl)disulfide, bis(4-iodophenyl)disulfide, bis(4-cyanophenyl)disulfide, bis(2,5-dichlorophenyl)disulfide, bis(3,5-dichlorophenyl)disulfide, bis(2,6-dichlorophenyl)disulfide, bis(2,5-dibromophenyl)disulfide, bis(3,5-dibromophenyl)disulfide, bis(2-chloro-5-bromophenyl)disulfide, bis(2-cyano-5-bromophenyl)disulfide, bis(2,4,6-trichlorophenyl)disulfide, bis(2-cyano-4-chloro-6-bromophenyl)disulfide, bis(2,3,5,6-tetrachlorophenyl)disulfide, bis(2,3,4,5,6-pentachlorophenyl)disulfide, and bis(2,3,4,5,6-pentabromophenyl)disulfide.

In light of resilience performance of the golf ball 2, the amount of the organic sulfur compound per 100 parts by weight of the base rubber is preferably not less than 0.1 parts by weight and particularly preferably not less than 0.2 parts by weight. In light of feel at impact, the amount of the organic sulfur compound is preferably not greater than 1.5 parts by weight, more preferably not greater than 1.0 part by weight, and particularly preferably not greater than 0.8 parts by weight. Two or more organic sulfur compounds may be used in combination.

The rubber composition of the core 4 may include a filler for the purpose of specific gravity adjustment and the like. Examples of suitable fillers include zinc oxide, barium sulfate, calcium carbonate, and magnesium carbonate. The amount of the filler is determined as appropriate so that the intended specific gravity of the core 4 is accomplished.

The rubber composition may include various additives, such as sulfur, a carboxylic acid, a carboxylate, an anti-aging agent, a coloring agent, a plasticizer, a dispersant, and the like, in an adequate amount. The rubber composition may include crosslinked rubber powder or synthetic resin powder.

The radius Rc of the core 4 is not particularly limited, and is adjusted as appropriate within the range where the aforementioned formulas (6) to (8) are satisfied. In light of resilience performance, the radius Rc is preferably not less than 17.0 mm, more preferably not less than 17.5 mm, and particularly preferably not less than 18.0 mm. In light of feel at impact, the radius Rc is preferably not greater than 20.0 mm, more preferably not greater than 19.7 mm, and particularly preferably not greater than 19.5 mm.

The Shore C hardness Hs at the surface of the core 4 is not particularly limited, and is adjusted as appropriate within the range where the aforementioned formulas (6) to (8) are satisfied. In light of spin suppression upon a shot with a driver, the Shore C hardness Hs at the surface of the core 4 is preferably not less than 70 and more preferably not less than 75. In light of feel at impact, the hardness Hs is preferably not greater than 97 and more preferably not greater than 95.

In light of feel at impact, the Shore C hardness Hc at the central point of the core 4 is preferably not less than 40 and more preferably not less than 45. In light of spin suppression, the hardness Hc is preferably not greater than 65 and more preferably not greater than 63.

The difference (Hs−Hc) between the hardness Hs and the hardness Hc is preferably not less than 15. The core 4 having a difference (Hs−Hc) of not less than 15 has a so-called outer-hard/inner-soft structure. When the golf ball 2 including the core 4 is hit with a driver, the spin is suppressed. The golf ball 2 including the core 4 has excellent flight performance upon a shot with a driver.

In light of flight performance, the difference (Hs−Hc) is more preferably not less than 16 and particularly preferably not less than 17. In light of feel at impact, the difference (Hs−Hc) is preferably not greater than 35 and more preferably not greater than 33.

The core 4 preferably has a weight of not less than 10 g but not greater than 42 g. The temperature for vulcanizing the core 4 is equal to or higher than 140° C. but equal to or lower than 180° C. The time period for vulcanizing the core 4 is equal to or longer than 10 minutes but equal to or shorter than 60 minutes.

In light of feel at impact, the core 4 has an amount of compressive deformation Dc of preferably not less than 2.8 mm and particularly preferably not less than 3.2 mm. In light of resilience performance of the core 4, the amount of compressive deformation Dc is preferably not greater than 5.2 mm and particularly preferably not greater than 4.8 mm.

A resin composition is suitably used for the main cover 8. Examples of the base resin of the resin composition include ionomer resins, polystyrenes, polyesters, polyamides, and polyolefins.

A particularly preferable base resin is an ionomer resin. The golf ball 2 including the main cover 8 that includes an ionomer resin has excellent resilience performance. An ionomer resin and another resin may be used in combination for the main cover 8. In this case, the principal component of the base resin is preferably the ionomer resin. Specifically, the proportion of the ionomer resin to the entire base resin is preferably not less than 70% by weight, more preferably not less than 80% by weight, and particularly preferably not less than 90% by weight.

Examples of preferable ionomer resins include binary copolymers formed with an α-olefin and an α,β-unsaturated carboxylic acid having 3 to 8 carbon atoms. A preferable binary copolymer includes 80% by weight or more but 90% by weight or less of an α-olefin, and 10% by weight or more but 20% by weight or less of an α,β-unsaturated carboxylic acid. The binary copolymer has excellent resilience performance. Examples of other preferable ionomer resins include ternary copolymers formed with: an α-olefin; an α,β-unsaturated carboxylic acid having 3 to 8 carbon atoms; and an α,β-unsaturated carboxylate ester having 2 to 22 carbon atoms. A preferable ternary copolymer includes 70% by weight or more but 85% by weight or less of an α-olefin, 5% by weight or more but 30% by weight or less of an α,β-unsaturated carboxylic acid, and 1% by weight or more but 25% by weight or less of an α,β-unsaturated carboxylate ester. The ternary copolymer has excellent resilience performance. For the binary copolymer and the ternary copolymer, preferable α-olefins are ethylene and propylene, while preferable α,β-unsaturated carboxylic acids are acrylic acid and methacrylic acid. Particularly preferable ionomer resins are a copolymer formed with ethylene and acrylic acid and a copolymer formed with ethylene and methacrylic acid.

In the binary copolymer and the ternary copolymer, some of the carboxyl groups are neutralized with metal ions. Examples of metal ions for use in neutralization include sodium ion, potassium ion, lithium ion, zinc ion, calcium ion, magnesium ion, aluminum ion, and neodymium ion. The neutralization may be carried out with two or more types of metal ions. Particularly suitable metal ions in light of resilience performance and durability of the golf ball 2 are sodium ion, zinc ion, lithium ion, and magnesium ion.

Specific examples of ionomer resins include: trade names "Himilan #1555", "Himilan #1557", "Himilan #1605", "Himilan #1706", "Himilan #1707", "Himilan #1856", "Himilan #1855", "Himilan AM7337", "Himilan AM7311", "Himilan AM7315", "Himilan AM7317", "Himilan AM7318", "Himilan AM7329", "Himilan MK7320", and "Himilan MK7329", manufactured by Du Pont-MITSUI POLYCHEMICALS Co., Ltd.; trade names "Surlyn #6120", "Surlyn #6910", "Surlyn #7930", "Surlyn #7940", "Surlyn #8140", "Surlyn #8150", "Surlyn #8940", "Surlyn #8945", "Surlyn #9120", "Surlyn #9150", "Surlyn #9910", "Surlyn #9945", "Surlyn AD8546", "HPF1000", and "HPF2000", manufactured by E.I. du Pont de Nemours and Company; and trade names "IOTEK 7010", "IOTEK 7030", "IOTEK 7510", "IOTEK 7520", "IOTEK 8000", and "IOTEK 8030", manufactured by ExxonMobil Chemical Corporation.

Two or more ionomer resins may be used in combination for the main cover 8. An ionomer resin neutralized with monovalent metal ions and an ionomer resin neutralized with bivalent metal ions may be used in combination. An ionomer resin and a highly elastic resin such as polyamide may be used in combination for the main cover 8.

As necessary, a coloring agent such as titanium dioxide, a filler such as barium sulfate, a dispersant, an antioxidant, an ultraviolet absorber, a light stabilizer, a fluorescent material, a fluorescent brightener, and the like are included in the resin composition of the main cover 8 in an adequate amount.

The Shore C hardness Hm of the main cover 8 is adjusted as appropriate within the range where the aforementioned formulas (6) to (8) are satisfied, and the main cover 8 is preferably harder than the outer cover 10. The main cover 8 is more preferably harder than the inner cover 6. The golf ball 2 including the main cover 8 that is hard has excellent flight performance upon a shot with a driver. From this viewpoint, the hardness Hm is preferably not less than 80, more preferably not less than 83, and particularly preferably not less than 85. In light of feel at impact, the hardness Hm is preferably not greater than 99 and more preferably not greater than 97.

The thickness Tm of the main cover 8 is adjusted as appropriate within the range where the aforementioned formulas (6) to (8) are satisfied. In light of flight performance upon a shot with a driver and feel at impact upon putting, the thickness Tm is preferably not less than 0.8 mm, more preferably not less than 0.9 mm, and particularly preferably not less than 1.0 mm. In light of feel at impact upon a shot with a driver, the thickness Tm is preferably not greater than 2.0 mm and more preferably not greater than 1.9 mm.

A resin composition is suitably used for the inner cover 6. Examples of the base resin of the resin composition include ionomer resins, polystyrenes, polyesters, polyamides, and polyolefins.

A particularly preferable base resin is an ionomer resin. The ionomer resins described above for the main cover 8 can be used. An ionomer resin and another resin may be used in combination for the inner cover 6. In this case, the proportion of the ionomer resin to the entire base resin is preferably not less than 40% by weight, more preferably not less than 50% by weight, and particularly preferably not less than 60% by weight.

A preferable resin that can be used in combination with an ionomer resin is a styrene block-containing thermoplastic elastomer. The styrene block-containing thermoplastic elastomer has excellent compatibility with ionomer resins. A resin composition including the styrene block-containing thermoplastic elastomer has excellent fluidity.

The styrene block-containing thermoplastic elastomer includes: a polystyrene block as a hard segment; and a soft segment. A typical soft segment is a diene block. Examples of compounds for the diene block include butadiene, isoprene, 1,3-pentadiene, and 2,3-dimethyl-1,3-butadiene. Butadiene and isoprene are preferable. Two or more compounds may be used in combination.

Examples of styrene block-containing thermoplastic elastomers include styrene-butadiene-styrene block copolymers (SBS), styrene-isoprene-styrene block copolymers (SIS), styrene-isoprene-butadiene-styrene block copolymers (SIBS), hydrogenated SBS, hydrogenated SIS, and hydrogenated SIBS. Examples of hydrogenated SBS include styrene-ethylene-butylene-styrene block copolymers (SEBS). Examples of hydrogenated SIS include styrene-ethylene-propylene-styrene block copolymers (SEPS). Examples of hydrogenated SIBS include styrene-ethylene-ethylene-propylene-styrene block copolymers (SEEPS).

In light of flight performance of the golf ball 2, the content of the styrene component in the styrene block-containing thermoplastic elastomer is preferably not less than 10% by weight, more preferably not less than 12% by weight, and particularly preferably not less than 15% by weight. In light of resilience performance of the golf ball 2, the content is preferably not greater than 50% by weight, more preferably not greater than 47% by weight, and particularly preferably not greater than 45% by weight.

In the present invention, styrene block-containing thermoplastic elastomers include a polymer alloy of an olefin and one or more members selected from the group consisting of SBS, SIS, and SIBS, and hydrogenated products thereof. The olefin component in the polymer alloy is presumed to contribute to improvement of compatibility with ionomer resins. The resilience performance of the golf ball 2 is improved by using the polymer alloy. An olefin having 2 to 10 carbon atoms is preferably used. Examples of suitable olefins include ethylene, propylene, butene, and pentene. Ethylene and propylene are particularly preferable.

Specific examples of polymer alloys include trade names "RABALON T3221C", "RABALON T3339C", "RABALON SJ4400N", "RABALON SJ5400N", "RABALON SJ6400N", "RABALON SJ7400N", "RABALON SJ8400N", "RABALON SJ9400N", and "RABALON SR04", manufactured by Mitsubishi Chemical Corporation. Other specific examples of styrene block-containing thermoplastic elastomers include trade name "Epofriend A1010" manufactured by Daicel Chemical Industries, Ltd., and trade name "SEPTON HG-252" manufactured by Kuraray Co., Ltd.

As necessary, a coloring agent such as titanium dioxide, a filler such as barium sulfate, a dispersant, an antioxidant, an ultraviolet absorber, a light stabilizer, a fluorescent material, a fluorescent brightener, and the like are included in the resin composition of the inner cover 6 in an adequate amount.

The Shore C hardness Hi of the inner cover 6 is adjusted as appropriate within the range where the aforementioned formulas (6) to (8) are satisfied, and the inner cover 6 is preferably more flexible than the main cover 8 as described above. The inner cover 6 that is relatively flexible can contribute to improvement of feel at impact upon a shot with a driver. From this viewpoint, the hardness Hi is preferably not greater than 80, more preferably not greater than 78, and particularly preferably not greater than 76. In light of flight performance, the hardness Hi is preferably not less than 50 and more preferably not less than 55.

The thickness Ti of the inner cover 6 is adjusted as appropriate within the range where the aforementioned formulas (6) to (8) are satisfied. In light of feel at impact upon putting, the thickness Ti is preferably not greater than 1.3 mm, more preferably not greater than 1.2 mm, and particularly preferably not greater than 1.1 mm. In light of feel at impact upon a shot with a driver, the thickness Ti is preferably not less than 0.6 mm and more preferably not less than 0.7 mm.

A resin composition is suitably used for the outer cover 10. The base resin of the resin composition of the outer cover 10 is preferably a urethane resin or a urea resin and is more preferably a urethane resin. The principal component of the urethane resin is a polyurethane. The polyurethane is flexible. The outer cover 10 formed from a resin composition that includes a polyurethane can contribute to feel at impact upon hitting with a putter.

A more preferable base resin of the resin composition of the outer cover 10 is a thermoplastic polyurethane elastomer.

The thermoplastic polyurethane elastomer includes a polyurethane component as a hard segment and a polyester component or a polyether component as a soft segment.

The polyurethane component has, within the molecule, a urethane bond formed by a reaction of a polyol and an isocyanate. The polyol has a plurality of hydroxyl groups. Low-molecular-weight polyols and high-molecular-weight polyols can be used.

Examples of isocyanates for the polyurethane component include alicyclic diisocyanates, aromatic diisocyanates, and aliphatic diisocyanates. Two or more diisocyanates may be used in combination.

Examples of alicyclic diisocyanates include 4,4'-dicyclohexylmethane diisocyanate ($H_{12}MDI$), 1,3-bis(isocyanatomethyl)cyclohexane ($H_6XDI$), isophorone diisocyanate (IPDI), and trans-1,4-cyclohexane diisocyanate (CHDI). In light of versatility and processability, $H_{12}MDI$ is preferable.

Examples of aromatic diisocyanates include 4,4'-diphenylmethane diisocyanate (MDI) and toluene diisocyanate (TDI). An example of aliphatic diisocyanates is hexamethylene diisocyanate (HDI).

Alicyclic diisocyanates are particularly preferable. Since an alicyclic diisocyanate does not have any double bond in the main chain, the alicyclic diisocyanate suppresses yellowing of the outer cover 10. In addition, since an alicyclic diisocyanate has excellent strength, the alicyclic diisocyanate suppresses damage of the outer cover 10.

Specific examples of thermoplastic polyurethane elastomers include: trade names "Elastollan NY80A", "Elastollan NY82A", "Elastollan NY83A", "Elastollan NY84A", "Elastollan NY85A", "Elastollan NY88A", "Elastollan NY90A", "Elastollan NY97A", "Elastollan NY585", "Elastollan XKP016N", "Elastollan 1195ATR", "Elastollan ET890A", and "Elastollan ET88050", manufactured by BASF Japan Ltd.; and trade names "RESAMINE P4585LS" and "RESAMINE PS62490", manufactured by Dainichiseika Color & Chemicals Mfg. Co., Ltd.

A thermoplastic polyurethane elastomer and another resin may be used in combination. Examples of the resin that can be used in combination include thermoplastic polyester elastomers, thermoplastic polyamide elastomers, thermoplastic polyolefin elastomers, styrene block-containing thermoplastic elastomers, and ionomer resins. When a thermoplastic polyurethane elastomer and another resin are used in combination, the thermoplastic polyurethane elastomer is included as the principal component of the base resin, in light of feel at impact. The proportion of the thermoplastic polyurethane elastomer to the entire base resin is preferably not less than 70% by weight, more preferably not less than 80% by weight, and particularly preferably not less than 90% by weight.

As necessary, a pigment component such as a white pigment (for example, titanium dioxide), a blue pigment, a red pigment, and the like, a weight adjusting agent such as zinc oxide, calcium carbonate, barium sulfate, and the like, a dispersant, an anti-aging agent, an ultraviolet absorber, a light stabilizer, a fluorescent material, a fluorescent brightener, and the like can be included in an adequate amount in the outer cover 10.

The Shore C hardness Ho of the outer cover 10 is adjusted as appropriate within the range where the aforementioned formulas (6) to (8) are satisfied. The outer cover 10 is preferably the most flexible among the inner cover 6, the main cover 8, and the outer cover 10. The golf ball 2 including the outer cover 10 that is flexible can have favorable feel at impact. In light of feel at impact upon a shot with a driver, the hardness Ho is preferably not greater than 60, more preferably not greater than 55, and particularly preferably not greater than 50. In light of feel at impact upon putting, the hardness Ho is preferably not less than 35 and more preferably not less than 40.

The thickness To of the outer cover 10 is adjusted as appropriate within the range where the aforementioned formulas (6) to (8) are satisfied. The outer cover 10 is preferably the thinnest among the inner cover 6, the main cover 8, and the outer cover 10. The outer cover 10 that is thin can contribute to improvement of feel at impact. In light of feel at impact upon putting, the thickness To is preferably not greater than 0.8 mm, more preferably not greater than 0.7 mm, and particularly preferably not greater than 0.6 mm. In light of feel at impact upon a shot with a driver, the thickness To is preferably not less than 0.2 mm and more preferably not less than 0.3 mm.

When the resin composition forming the main cover 8 and the resin composition forming the outer cover 10 include different types of base resins, the golf ball 2 may include a reinforcing layer between the main cover 8 and the outer cover 10. The reinforcing layer firmly adheres to the main cover 8 and also to the outer cover 10. The reinforcing layer suppresses separation of the outer cover 10 from the main cover 8. The reinforcing layer is formed from a resin composition. Examples of a preferable base resin of the resin composition include two-component curing type epoxy resins and two-component curing type urethane resins.

In light of feel at impact, the difference (Hm−Ho) between the hardness Hm of the main cover 8 and the hardness Ho of the outer cover 10 is preferably not less than 20 and more preferably not less than 30. In light of flight performance, the difference (Hm−Ho) is preferably not greater than 60 and more preferably not greater than 55.

In light of feel at impact upon putting, the difference (Hm−Hi) between the hardness Hm of the main cover 8 and the hardness Hi of the inner cover 6 is preferably not less than 5 and more preferably not less than 8. In light of flight performance, the difference (Hm−Hi) is preferably not greater than 50 and more preferably not greater than 45.

In light of feel at impact upon putting, the difference (Tm−To) between the thickness Tm of the main cover 8 and the thickness To of the outer cover 10 is preferably not less than 0.3 mm and more preferably not less than 0.5 mm. In light of flight performance, the difference (Tm−To) is preferably not greater than 1.2 mm and more preferably not greater than 1.1 mm.

In light of feel at impact upon a shot with a driver, the difference (Ti−To) between the thickness Ti of the inner cover 6 and the thickness To of the outer cover 10 is preferably not less than 0.2 mm and more preferably not less than 0.3 mm. In light of flight performance, the difference (Ti−To) is preferably not greater than 1.0 mm and more preferably not greater than 0.9 mm.

In light of resilience performance, the sum (Ti+Tm+To) of the thickness Ti, the thickness Tm, and the thickness To is preferably not greater than 3.5 mm and more preferably not greater than 3.1 mm. In light of feel at impact, the sum (Ti+Tm+To) is preferably not less than 1.5 mm and more preferably not less than 2.0 mm.

For forming the inner cover 6, the main cover 8, and the outer cover 10, known methods such as injection molding, compression molding, and the like can be used. When forming the outer cover 10, the dimples 12 are formed by pimples formed on the cavity face of a mold.

In light of feel at impact, the golf ball 2 has an amount of compressive deformation Db of preferably not less than 2.3 mm and more preferably not less than 2.5 mm. In light of resilience performance, the amount of compressive deformation Db is preferably not greater than 4.0 mm and more preferably not greater than 3.8 mm.

For measurement of the amount of compressive deformation, a YAMADA type compression tester is used. In the tester, a sphere such as the core 4, the golf ball 2, or the like is placed on a hard plate made of metal. Next, a cylinder made of metal gradually descends toward the sphere. The sphere, squeezed between the bottom face of the cylinder and the hard plate, becomes deformed. A migration distance of the cylinder, starting from the state in which an initial load of 98 N is applied to the sphere up to the state in which a final load of 1274 N is applied thereto, is measured.

EXAMPLES

The following will show the effects of the present invention by means of Examples, but the present invention should not be construed in a limited manner based on the description of these Examples.

Example 1

A rubber composition E1 was obtained by kneading 100 parts by weight of a polybutadiene rubber (trade name "BR730", manufactured by JSR Corporation), 5 parts by weight of zinc oxide (trade name "Ginrei (registered trademark) R", manufactured by Toho Zinc Co., Ltd.), 30.0 parts by weight of zinc diacrylate (trade name "Sanceler (registered trademark) SR" manufactured by SANSHIN CHEMICAL INDUSTRY CO., LTD.), an appropriate amount of barium sulfate (trade name "Barium Sulfate BD" manufactured by Sakai Chemical Industry Co., Ltd.), 0.3 parts by weight of PBDS (bis(pentabromophenyl)disulfide, manufactured by Kawaguchi Chemical Industry Co., Ltd.), 0.9 parts by weight of dicumyl peroxide (trade name "Percumyl (registered trademark) D" manufactured by NOF Corporation), and 2 parts by weight of benzoic acid (manufactured by Emerald Kalama Chemical, LLC). This rubber composition E1 was placed into a mold including upper and lower mold halves each having a hemispherical cavity, and heated at 150° C. for 20 minutes to obtain a core with a radius of 19.1 mm. The amount of barium sulfate was adjusted such that the weight of a golf ball was appropriate.

A resin composition c was obtained by kneading 38.5 parts by weight of an ionomer resin (the aforementioned "Himilan AM7337"), 38.5 parts by weight of another ionomer resin (the aforementioned "Himilan AM7329"), 23 parts by weight of a styrene block-containing thermoplastic elastomer (the aforementioned "RABALON T3221C"), 4 parts by weight of titanium dioxide, and 0.2 parts by weight of a light stabilizer (trade name "JF-90", manufactured by Johoku Chemical Co., Ltd.) with a twin-screw kneading extruder. The core was placed into a mold including upper and lower mold halves each having a hemispherical cavity. By injection molding, the resin composition c was injected around the core to form an inner cover with a thickness of 1.0 mm.

A resin composition e was obtained by kneading 55 parts by weight of an ionomer resin (the aforementioned "Himilan AM7329"), 45 parts by weight of another ionomer resin (the aforementioned "Himilan #1555"), 4 parts by weight of titanium dioxide, and 0.2 parts by weight of a light stabilizer (the aforementioned "JF-90") with a twin-screw kneading extruder. The sphere consisting of the core and the inner cover was placed into a mold including upper and lower mold halves each having a hemispherical cavity. By injection molding, the resin composition e was injected around the sphere consisting of the core and the inner cover to form a main cover with a thickness of 1.0 mm.

A paint composition (trade name "POLIN 750LE", manufactured by SHINTO PAINT CO., LTD.) including a two-component curing type epoxy resin as a base polymer was prepared. The base material liquid of this paint composition includes 30 parts by weight of a bisphenol A type epoxy resin and 70 parts by weight of a solvent. The curing agent liquid of this paint composition includes 40 parts by weight of a modified polyamide amine, 55 parts by weight of a solvent, and 5 parts by weight of titanium dioxide. The weight ratio of the base material liquid to the curing agent liquid is 1/1. This paint composition was applied to the surface of the main cover with a spray gun, and kept at 23° C. for 12 hours to obtain a reinforcing layer with a thickness of 10 μm.

A resin composition g was obtained by kneading 100 parts by weight of a thermoplastic polyurethane elastomer (the aforementioned "Elastollan NY80A"), 0.2 parts by weight of a light stabilizer (trade name "TINUVIN 770"), 4 parts by weight of titanium dioxide, and 0.04 parts by weight of ultramarine blue with a twin-screw kneading extruder. The sphere consisting of the core, the inner cover, and the main cover was placed into a final mold having a large number of pimples on its cavity face. By injection molding, the resin composition g was injected around the sphere to form an outer cover with a thickness of 0.3 mm. Dimples having a shape that is the inverted shape of the pimples were formed on the outer cover. A clear paint including a two-component curing type polyurethane as a base material was applied to this outer cover to obtain a golf ball of Example 1 with a diameter of 42.8 mm.

Examples 2 to 13 and Comparative Examples 1 to 12

Golf balls of Examples 2 to 13 and Comparative Examples 1 to 12 were obtained in the same manner as Example 1, except the specifications of the core, the inner cover, the main cover, and the outer cover were as shown in Tables 4 to 8. The composition of the core is shown in detail in Table 1 below. The compositions of the inner cover and the main cover are shown in detail in Table 2 below. The composition of the outer cover is shown in detail in Table 3 below.

[Flight Performance 1: Hit with Driver (W #1)]

A driver (trade name "XXIO9", manufactured by DUNLOP SPORTS CO. LTD., shaft: MP900, shaft hardness: R, loft angle: 10.5 degrees) was attached to a swing machine manufactured by Golf Laboratories, Inc. A golf ball was hit under a condition of a head speed of 40 m/s, and the initial speed (m/s), the spin rate (rpm), and the total flight distance (m) of the golf ball were measured. The total flight distance is the distance between the point at the hit and the point at which the golf ball stopped. The average of values obtained from 12 measurements is shown in Tables 4 to 8 below.

[Feel at Impact 1: Hit with Driver (W #1)]

Ten golf players hit golf balls with drivers and were asked about feel at impact. The evaluation was categorized as follows on the basis of the number of golf players who answered, "the feel at impact was favorable". The results are shown in Tables 4 to 8 below.

S: 8 to 10
A: 6 and 7
B: 4 and 5
C: 0 to 3

[Feel at Impact 2: Hit with Putter]

On flat lawn, 10 golf players hit golf balls with putters toward a hitting target and were asked about feel at impact. The direct distance from the hitting point to the hitting target was 10 m. The evaluation was categorized as follows on the basis of the number of golf players who answered, "the feeling was favorable and the sense of distance was easily adjusted". The results are shown in Tables 4 to 8 below.

S: 8 to 10

A: 6 and 7

B: 4 and 5

C: 0 to 3

TABLE 1

Composition of Core (parts by weight)

| Type | E1 | E2 |
|---|---|---|
| Polybutadiene rubber | 100 | 100 |
| Zinc oxide | 5 | 5 |
| Zinc diacrylate | 30.0 | 25.5 |
| Barium sulfate | * | * |
| PBDS | 0.3 | 0.3 |
| DPDS | — | 0.3 |
| Dicumyl peroxide | 0.9 | 0.9 |
| Benzoic acid | 2 | — |
| Vulc. temp. (° C.) | 150 | 150 |
| Vulc. time (min) | 20 | 20 |

* Appropriate amount

The details of the compounds listed in Table 1 are as follows.

Polybutadiene rubber: trade name "BR730 (cis-bond content: 96% by weight)" manufactured by JSR Corporation Zinc oxide: trade name "Ginrei R" manufactured by Toho Zinc Co., Ltd.

Zinc diacrylate: trade name "Sanceler SR" manufactured by SANSHIN CHEMICAL INDUSTRY CO., LTD. (a product coated with 10% by weight of stearic acid)

Barium sulfate: trade name "Barium Sulfate BD" manufactured by Sakai Chemical Industry Co., Ltd.

PBDS: bis(pentabromophenyl)disulfide manufactured by Kawaguchi Chemical Industry Co., Ltd.

DPDS: diphenyl disulfide manufactured by Sumitomo Seika Chemicals Co., Ltd.

Dicumyl peroxide: trade name "Percumyl D" manufactured by NOF Corporation

Benzoic acid: a product of Emerald Kalama Chemical, LLC

TABLE 2

Compositions of Inner Cover and Main Cover (parts by weight)

| Type | a | b | c | d | e | f | j |
|---|---|---|---|---|---|---|---|
| Himilan AM7337 | 26 | 30 | 38.5 | — | — | — | 36.5 |
| Himilan AM7329 | 26 | 30 | 38.5 | 45 | 55 | 50 | 36.5 |
| Himilan #1605 | — | — | — | — | — | 25 | — |
| Himilan #1555 | — | — | — | 50 | 45 | — | — |
| Surlyn #8150 | — | — | — | — | — | 25 | — |
| Rabalon T3221C | 48 | 40 | 23 | 5 | — | — | 27 |
| Titanium dioxide | 4 | 4 | 4 | 4 | 4 | 4 | 4 |
| JF-90 | 0.2 | 0.2 | 0.2 | 0.2 | 0.2 | 0.2 | 0.2 |
| Slab hardness (Shore C) | 57 | 63 | 76 | 88 | 92 | 98 | 73 |

JF-90 listed in Table 2 is bis(2,2,6,6-tetramethyl-4-piperidyl)sebacate (light stabilizer) manufactured by Johoku Chemical Co., Ltd.

TABLE 3

Composition of Outer Cover (parts by weight)

| Type | g | h | i |
|---|---|---|---|
| Elastollan NY80A | 100 | — | — |
| Elastollan NY82A | — | 100 | — |
| Elastollan NY90A | — | — | 90 |
| Elastollan NY97A | | | 10 |
| TINUVIN 770 | 0.2 | 0.2 | 0.2 |
| Titanium dioxide | 4 | 4 | 4 |
| Ultramarine blue | 0.04 | 0.04 | 0.04 |
| Slab hardness (Shore C) | 46 | 49 | 63 |

TABLE 4

Results of Evaluation

| | Ex. 1 | Ex. 2 | Ex. 3 | Ex. 4 | Ex. 5 |
|---|---|---|---|---|---|
| Core | E1 | E2 | E1 | E1 | E1 |
| Rc (mm) | 19.1 | 19.1 | 19.1 | 19.3 | 18.9 |
| Hc (Shore C) | 54 | 60 | 54 | 54 | 54 |
| Hs (Shore C) | 80 | 76 | 80 | 80 | 80 |
| Inner cover | c | c | c | c | a |
| Ti (mm) | 1.0 | 1.0 | 0.8 | 0.8 | 1.0 |
| Hi (Shore C) | 76 | 76 | 76 | 76 | 57 |
| Main cover | e | e | e | e | e |
| Tm (mm) | 1.0 | 1.0 | 1.0 | 1.0 | 1.0 |
| Hm (Shore C) | 92 | 92 | 92 | 92 | 92 |
| Outer cover | g | g | g | g | g |
| To (mm) | 0.3 | 0.3 | 0.5 | 0.3 | 0.5 |
| Ho (Shore C) | 46 | 46 | 46 | 46 | 46 |
| (1) S = Hs × Rc × 0.05 | 76 | 73 | 76 | 77 | 76 |
| (2) M = Hm × Tm | 92 | 92 | 92 | 92 | 92 |
| (3) I = Hi × Ti | 76 | 76 | 61 | 61 | 57 |
| (4) O = Ho × To | 14 | 14 | 23 | 14 | 23 |
| (5) Q = (I + O)/2 | 45 | 45 | 42 | 37 | 40 |
| (6) M − S | 16 | 19 | 16 | 15 | 16 |
| (7) Q/M | 0.49 | 0.49 | 0.46 | 0.41 | 0.43 |
| (8) I − O | 63 | 63 | 38 | 47 | 34 |
| deformation (mm) | 2.88 | 2.88 | 2.93 | 2.93 | 2.93 |
| W#1 spin rate(rpm) | 2,430 | 2,470 | 2,465 | 2,380 | 2,425 |

TABLE 4-continued

| Results of Evaluation | | | | | |
|---|---|---|---|---|---|
| | Ex. 1 | Ex. 2 | Ex. 3 | Ex. 4 | Ex. 5 |
| W#1 speed (m/s) | 57.75 | 57.77 | 57.70 | 57.73 | 57.68 |
| W#1 distance (m) | 200.7 | 200.4 | 200.1 | 201.1 | 200.4 |
| W#1 feel at impact | A | A | S | A | S |
| Putter feel at impact | A | A | A | S | A |

TABLE 5

| Results of Evaluation | | | | | |
|---|---|---|---|---|---|
| | Ex. 6 | Ex. 7 | Ex. 8 | Ex. 9 | Ex. 10 |
| Core | E1 | E1 | E2 | E1 | E1 |
| Rc (mm) | 18.9 | 18.7 | 18.7 | 18.9 | 18.9 |
| Hc (Shore C) | 54 | 54 | 60 | 54 | 54 |
| Hs (Shore C) | 80 | 80 | 76 | 80 | 80 |
| Inner cover | a | a | a | a | b |
| Ti (mm) | 1.0 | 1.2 | 1.2 | 1.0 | 1.0 |
| Hi (Shore C) | 57 | 57 | 57 | 57 | 63 |
| Main cover | e | e | e | f | e |
| Tm (mm) | 1.0 | 1.0 | 1.0 | 1.0 | 1.0 |
| Hm (Shore C) | 92 | 92 | 92 | 98 | 92 |
| Outer cover | h | g | g | g | g |
| To (mm) | 0.5 | 0.5 | 0.5 | 0.5 | 0.5 |
| Ho (Shore C) | 49 | 46 | 46 | 46 | 46 |
| (1) S = Hs × Rc × 0.05 | 76 | 75 | 71 | 76 | 76 |
| (2) M = Hm × Tm | 92 | 92 | 92 | 98 | 92 |
| (3) I = Hi × Ti | 57 | 68 | 68 | 57 | 63 |
| (4) O = Ho × To | 25 | 23 | 23 | 23 | 23 |
| (5) Q = (I + O)/2 | 41 | 46 | 46 | 40 | 43 |
| (6) M − S | 16 | 17 | 21 | 22 | 16 |
| (7) Q/M | 0.45 | 0.50 | 0.50 | 0.41 | 0.47 |
| (8) I − O | 32 | 45 | 45 | 34 | 40 |
| deformation (mm) | 2.92 | 2.87 | 2.87 | 2.86 | 2.91 |
| W#1 spin rate(rpm) | 2,410 | 2,480 | 2,505 | 2,360 | 2,430 |
| W#1 speed (m/s) | 57.69 | 57.73 | 57.74 | 57.82 | 57.75 |
| W#1 distance (m) | 200.6 | 200.1 | 199.9 | 201.7 | 200.7 |
| W#1 feel at impact | S | S | S | A | S |
| Putter feel at impact | A | S | S | A | A |

TABLE 6

| Results of Evaluation | | | | | |
|---|---|---|---|---|---|
| | Ex. 11 | Ex. 12 | Ex. 13 | Comp. Ex. 1 | Comp. Ex. 2 |
| Core | E1 | E1 | E1 | E1 | E1 |
| Rc (mm) | 18.7 | 19.1 | 18.3 | 18.9 | 18.9 |
| Hc (Shore C) | 54 | 54 | 54 | 54 | 54 |
| Hs (Shore C) | 80 | 80 | 80 | 80 | 80 |
| Inner cover | a | j | c | c | a |
| Ti (mm) | 1.0 | 1.1 | 1.0 | 1.0 | 1.0 |
| Hi (Shore C) | 57 | 73 | 76 | 76 | 57 |
| Main cover | e | e | f | e | d |
| Tm (mm) | 1.2 | 1.0 | 1.6 | 1.0 | 1.0 |
| Hm (Shore C) | 92 | 92 | 98 | 92 | 88 |
| Outer cover | g | h | g | g | a |
| To (mm) | 0.5 | 0.2 | 0.5 | 0.5 | 0.5 |
| Ho (Shore C) | 46 | 49 | 46 | 46 | 57 |
| (1) S = Hs × Rc × 0.05 | 75 | 76 | 73 | 76 | 76 |
| (2) M = Hm × Tm | 110 | 92 | 157 | 92 | 88 |
| (3) I = Hi × Ti | 57 | 80 | 76 | 76 | 57 |
| (4) O = Ho × To | 23 | 10 | 23 | 23 | 29 |
| (5) Q = (I + O)/2 | 40 | 45 | 50 | 50 | 43 |
| (6) M − S | 35 | 16 | 84 | 16 | 12 |
| (7) Q/M | 0.36 | 0.49 | 0.32 | 0.54 | 0.49 |
| (8) I − O | 34 | 71 | 53 | 53 | 28 |
| deformation (mm) | 2.85 | 2.88 | 2.64 | 2.88 | 2.96 |
| W#1 spin rate(rpm) | 2,400 | 2,460 | 2,390 | 2,515 | 2,435 |
| W#1 speed (m/s) | 57.75 | 57.79 | 57.92 | 57.72 | 57.64 |
| W#1 distance (m) | 201.0 | 200.6 | 201.9 | 199.7 | 200.1 |

TABLE 6-continued

| Results of Evaluation | | | | | |
|---|---|---|---|---|---|
| | Ex. 11 | Ex. 12 | Ex. 13 | Comp. Ex. 1 | Comp. Ex. 2 |
| W#1 feel at impact | A | A | A | A | S |
| Putter feel at impact | A | B | A | A | C |

TABLE 7

| Results of Evaluation | | | | | |
|---|---|---|---|---|---|
| | Comp. Ex. 3 | Comp. Ex. 4 | Comp. Ex. 5 | Comp. Ex. 6 | Comp. Ex. 7 |
| Core | E1 | E1 | E1 | E1 | E1 |
| Rc (mm) | 18.5 | 18.8 | 19.1 | 18.0 | 18.4 |
| Hc (Shore C) | 54 | 54 | 54 | 54 | 54 |
| Hs (Shore C) | 80 | 80 | 80 | 80 | 80 |
| Inner cover | a | c | e | e | e |
| Ti (mm) | 1.4 | 0.8 | 0.8 | 1.2 | 1.0 |
| Hi (Shore C) | 57 | 76 | 92 | 92 | 92 |
| Main cover | e | e | a | a | a |
| Tm (mm) | 1.0 | 1.0 | 1.0 | 1.2 | 1.0 |
| Hm (Shore C) | 92 | 92 | 57 | 57 | 57 |
| Outer cover | g | g | g | g | g |
| To (mm) | 0.5 | 0.8 | 0.5 | 1.0 | 1.0 |
| Ho (Shore C) | 46 | 46 | 46 | 46 | 46 |
| (1) S = Hs × Rc × 0.05 | 74 | 75 | 76 | 72 | 74 |
| (2) M = Hm × Tm | 92 | 92 | 57 | 68 | 57 |
| (3) I = Hi × Ti | 79 | 61 | 74 | 110 | 92 |
| (4) O = Ho × To | 23 | 37 | 23 | 46 | 46 |
| (5) Q = (I + O)/2 | 51 | 49 | 48 | 78 | 69 |
| (6) M − S | 18 | 17 | −19 | −4 | −17 |
| (7) Q/M | 0.56 | 0.53 | 0.85 | 1.15 | 1.21 |
| (8) I − O | 56 | 24 | 51 | 64 | 46 |
| deformation (mm) | 2.85 | 2.89 | 2.99 | 2.77 | 2.91 |
| W#1 spin rate(rpm) | 2,535 | 2,510 | 2,500 | 2,625 | 2,530 |
| W#1 speed (m/s) | 57.71 | 57.68 | 57.62 | 57.79 | 57.69 |
| W#1 distance (m) | 199.4 | 199.6 | 199.4 | 198.9 | 199.4 |
| W#1 feel at impact | C | S | C | C | C |
| Putter feel at impact | A | C | S | B | S |

TABLE 8

| Results of Evaluation | | | | | |
|---|---|---|---|---|---|
| | Comp. Ex. 8 | Comp. Ex. 9 | Comp. Ex. 10 | Comp. Ex. 11 | Comp. Ex. 12 |
| Core | E1 | E1 | E1 | E1 | E2 |
| Rc (mm) | 18.9 | 18.9 | 18.1 | 18.9 | 19.5 |
| Hc (Shore C) | 54 | 54 | 54 | 54 | 60 |
| Hs (Shore C) | 80 | 80 | 80 | 80 | 76 |
| Inner cover | a | a | c | a | c |
| Ti (mm) | 1.0 | 1.0 | 1.0 | 0.8 | 0.8 |
| Hi (Shore C) | 57 | 57 | 76 | 57 | 76 |
| Main cover | c | e | f | f | f |
| Tm (mm) | 1.0 | 1.0 | 1.8 | 1.4 | 0.8 |
| Hm (Shore C) | 76 | 92 | 98 | 98 | 98 |
| Outer cover | g | i | g | g | g |
| To (mm) | 0.5 | 0.5 | 0.5 | 0.3 | 0.3 |
| Ho (Shore C) | 46 | 63 | 46 | 46 | 46 |
| (1) S = Hs × Rc × 0.05 | 76 | 76 | 72 | 76 | 74 |
| (2) M = Hm × Tm | 76 | 92 | 176 | 137 | 78 |
| (3) I = Hi × Ti | 57 | 57 | 76 | 46 | 61 |
| (4) O = Ho × To | 23 | 32 | 23 | 14 | 14 |
| (5) Q = (I + O)/2 | 40 | 44 | 50 | 30 | 37 |
| (6) M − S | 0 | 16 | 104 | 62 | 4 |
| (7) Q/M | 0.53 | 0.48 | 0.28 | 0.22 | 0.47 |
| (8) I − O | 34 | 25 | 53 | 32 | 47 |
| deformation (mm) | 3.03 | 2.91 | 2.48 | 2.72 | 2.93 |
| W#1 spin rate(rpm) | 2,500 | 2,380 | 2,440 | 2,390 | 2,460 |
| W#1 speed (m/s) | 57.55 | 57.70 | 58.10 | 57.89 | 57.68 |
| W#1 distance (m) | 199.1 | 201.0 | 202.1 | 201.7 | 199.9 |

TABLE 8-continued

| Results of Evaluation | | | | | |
|---|---|---|---|---|---|
| | Comp. Ex. 8 | Comp. Ex. 9 | Comp. Ex. 10 | Comp. Ex. 11 | Comp. Ex. 12 |
| W#1 feel at impact | S | B | C | C | B |
| Putter feel at impact | B | C | B | B | A |

As shown in Tables 4 to 8, in the golf ball according to each Example, various performance characteristics are improved in a balanced manner as compared to those of the golf ball of each Comparative Example. From the results of the evaluation, advantages of the present invention are clear.

The golf ball according to the present invention can be used for playing golf on golf courses and practicing at driving ranges. The above descriptions are merely illustrative examples, and various modifications can be made without departing from the principles of the present invention.

What is claimed is:

1. A golf ball comprising a core, an inner cover positioned outside the core, a main cover positioned outside the inner cover, and an outer cover positioned outside the main cover, wherein a TH value S at a surface of the core, a TH value M of the main cover, a TH value I of the inner cover, a TH value O of the outer cover, and an average Q are defined by the following formulas (1) to (5) from a radius Rc (mm) of the core, a Shore C hardness Hs at the surface of the core, a thickness Tm (mm) of the main cover, a Shore C hardness Hm of the main cover, a thickness Ti (mm) of the inner cover, a Shore C hardness Hi of the inner cover, a thickness To (mm) of the outer cover, and a Shore C hardness Ho of the outer cover, $$S=Hs\times Rc\times 0.05 \quad (1)$$

$$M=Hm\times Tm \quad (2)$$

$$I=Hi\times Ti \quad (3)$$

$$O=Ho\times To \quad (4)$$

$$Q=(I+O)/2 \quad (5), \text{ and}$$

the TH value S, the TH value M, the TH value I, the TH value O, and the average Q satisfy the following formulas (6) to (8), $$15\leq M-S\leq 100 \quad (6)$$

$$0.25<Q/M\leq 0.5 \quad (7)$$

$$30<I-O \quad (8),$$

wherein a difference (Hm−Ho) between the Shore C hardness Hm of the main cover and the Shore C hardness Ho of the outer cover is not less than 20 and not greater than 60.

2. The golf ball according to claim 1, wherein the TH value I and the TH value O satisfy the following formula (9), $$30<I-O\leq 70 \quad (9).$$

3. The golf ball according to claim 1, wherein the TH value I, the TH value M, and the TH value O satisfy the following formula (10), $$O<I<M \quad (10).$$

4. The golf ball according to claim 1, wherein the outer cover is the most flexible among the inner cover, the main cover, and the outer cover.

5. The golf ball according to claim 1, wherein the outer cover is the thinnest among the inner cover, the main cover, and the outer cover.

6. The golf ball according to claim 1, wherein the hardness Ho is not less than 35 and not greater than 60.

7. The golf ball according to claim 1, wherein the thickness To is not less than 0.2 mm and not greater than 0.8 mm.

8. The golf ball according to claim 1, wherein the TH value S and the TH value M further satisfy the following formula:

$$20\leq M-S\leq 100.$$

9. The golf ball according to claim 1, wherein the TH value M and the average Q further satisfy the following formula:

$$0.25<Q/M\leq 0.46.$$

10. The golf ball according to claim 1, wherein the core is a single layer.

11. The golf ball according to claim 1, wherein the core is formed by crosslinking a rubber composition, the inner cover and the main cover are formed by resin composition including an ionomer resin, and the outer cover is formed by resin composition including a urethane resin.

* * * * *